United States Patent [19]

Knape et al.

[11] 4,046,322

[45] Sept. 6, 1977

[54] FUEL INJECTION NOZZLE ASSEMBLY WITH STRETCH ELEMENT

[75] Inventors: Richard S. Knape, Grand Rapids; Robert D. Straub, Westland, both of Mich.

[73] Assignee: General Motors Corporation, Detroit, Mich.

[21] Appl. No.: 688,695

[22] Filed: May 21, 1976

[51] Int. Cl.[2] ..... B05B 1/30; F02M 61/16

[52] U.S. Cl. ..... 239/533.7; 239/533.13

[58] Field of Search ..... 239/453, 88, 533.9, 239/533.13, 533.7

[56] References Cited

U.S. PATENT DOCUMENTS

| | | | |
|---|---|---|---|
| 1,609,578 | 12/1926 | Scott | 239/453 |
| 1,755,192 | 4/1930 | Scott | 239/533.7 |
| 2,119,966 | 6/1938 | Scott | 239/533.9 X |
| 3,419,251 | 12/1968 | Eckert | 239/533.13 X |
| 3,442,456 | 5/1969 | Thompson et al. | 239/533.7 |

*Primary Examiner*—John J. Love
*Assistant Examiner*—Michael Mar
*Attorney, Agent, or Firm*—Arthur N. Krein

[57] ABSTRACT

A fuel injector nozzle assembly is provided in one embodiment with a nozzle body having a bored opening extending therethrough from an inlet end of the nozzle body to a spray tip end thereof, a valve being mounted in the nozzle body to extend through the bore to form with the nozzle body an annular fuel chamber, one end of the fuel chamber being connectable by a passage means in the inlet end of the nozzle body to a source of pressurized fuel, the valve having its stem end fixed to the inlet end of the nozzle body and having its head positioned to abut against a valve seat in the spray tip end of the nozzle body in a normally closed position, the stem of the valve intermediate its ends being of reduced diameter relative to the head whereby fuel, at a predetermined pressure in the fuel chamber, will effect longitudinal deformation, that is, lengthening or stretching of the valve a limited amount without causing permanent deformation whereby to cause unseating of the valve from the valve seat to permit the discharge of fuel from the fuel chamber out through the spray tip and, as the pressure of fuel in the fuel chamber is reduced, the valve will then contract to again effect seating of the valve.

In an alternate embodiment, the portion of the nozzle body forming the exterior wall of the fuel chamber is of reduced thickness and the inside diameter of the bore is of a predetermined size relative to the head of the valve whereby the nozzle body, per se, will stretch relative to the valve to thereby effect unseating of the valve head relative to the valve seat in the nozzle body when fuel above a predetermined pressure is supplied to the fuel chamber.

3 Claims, 3 Drawing Figures

FUEL INJECTION NOZZLE ASSEMBLY WITH STRETCH ELEMENT

Figure 1:
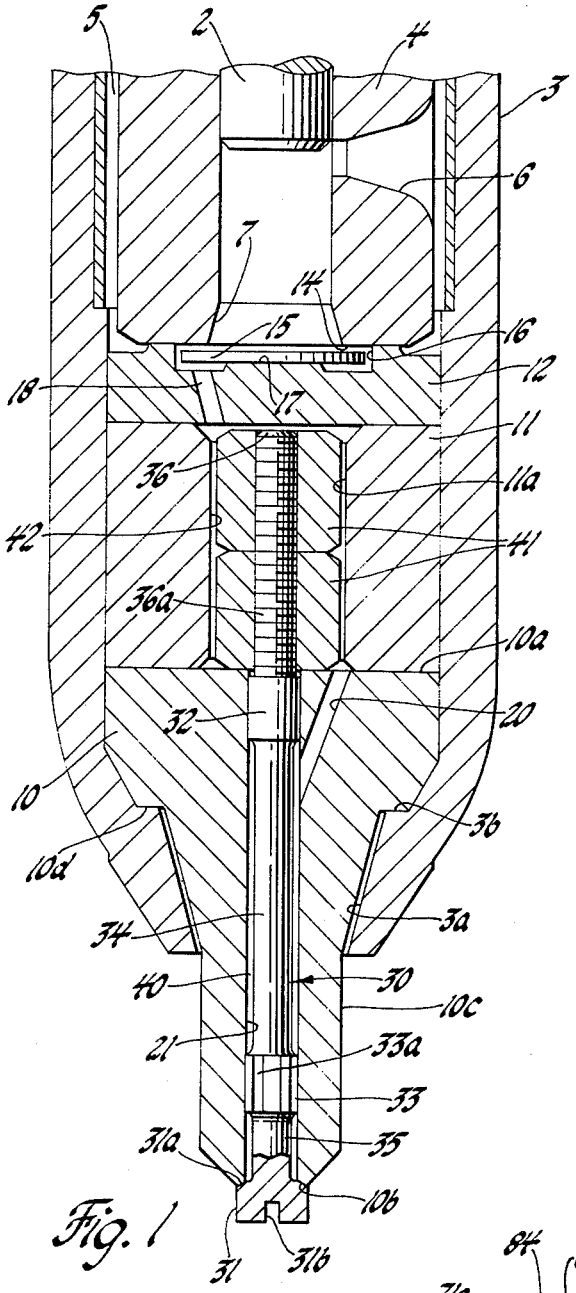

This invention relates to a device for injecting fuel into the cylinders of an internal combustion engine and, in particular, to a fuel injector nozzle assembly for such a device.

Fuel injectors or fuel injection nozzles, whether used as part of a unit injector or as part of a pump and nozzle system, are normally of the needle valve controlled type that includes a nozzle body having a spray tip at one end thereof with spray orifices therein in communication with an axial passage in the nozzle body supplied with fuel under pressure, flow of fuel through the passage to the spray orifices being controlled by a needle valve having a seat at one end thereof adapted to cooperate with a seat in the nozzle body upstream of the spray orifices, the needle valve being normally biased to a closed position by a closing spring. In this type fuel injector, there is normally at least some so-called "sac volume" when the needle valve is closed between its seat and the discharge end of the spray orifices, which sac volume contains raw fuel after the injection cycle has been terminated that can then dribble into the cylinder of the engine with which the fuel injector is associated.

It is also well known in the art of fuel injection that the needle valve on both opening and closing relative to a valve seat will provide a flow area less than that of the spray orifices. This causes the very first fuel and the very last fuel injected to be poorly atomized and causes dribble. And further, in those nozzles where the needle seat is formed over the spray orifices for the purpose of preventing the sac volume from escaping, there is still raw fuel in the spray orifices which cannot be prevented from entering the combustion chamber of the associated engine. This invention, in a preferred embodiment, eliminates that possibility.

In addition, in these prior art needle valve type injectors or nozzles, the force of the closing spring must be sufficient to effect seating of the needle valve against cylinder pressure which acts to hold the needle valve open.

It is therefore a primary object of this invention to provide an improved fuel injector nozzle assembly wherein fuel delivery is controlled by a nozzle valve and nozzle body assembly wherein one of the elements is stretched in response to a predetermined fuel pressure to effect opening of the nozzle valve relative to its seat in the nozzle body.

Another object of this invention is to provide an improved fuel injector nozzle assembly including a valve fixed at one end in a nozzle body wherein the fuel delivery therefrom is controlled by stretching of one of these elements relative to the other element.

A further object of this invention is to provide an improved fuel injector nozzle assembly that is of simple but rugged construction and that is readily and economically manufactured.

These and other objects of the invention are obtained by a fuel injector nozzle assembly including a nozzle body having a spray tip at one end thereof, the nozzle body having a stepped bore extending from the opposite end of the nozzle body to communicate with the spray tip and forming at the spray tip an annular valve seat, a valve being positioned to extend through the stepped bore in the nozzle body with one end of the valve positioned in abutment against the valve seat, the opposite end of the valve being rigidly connected to the opposite end of the nozzle body, the stem of the valve intermediate its ends being of a reduced diameter to form with the stepped bore in the nozzle body an annular fuel chamber in communication at one end with the valve seat as controlled by the valve, the nozzle body further including a fuel inlet passage connected at one end to the fuel chamber and connectable at its other end to a source of pressurized fuel, the predetermined diameter of the stem of the valve being such that the fuel, at a predetermined high fuel pressure in the annular fuel chamber, can act on the head of the valve to cause the valve stem to stretch whereby to effect unseating of the valve head from the valve seat whereby fuel can be ejected from the nozzle. In an alternate embodiment, the nozzle body is acted upon by fuel at a predetermined fuel pressure to stretch the valve body relative to its cooperating valve whereby to effect unseating of the valve from the valve seat in the nozzle body so as to permit the discharge of fuel from the fuel chamber in the valve body surrounding the stem of the valve. In either embodiment, when fuel pressure is decreased, the stretched element can then contract to its original longitudinal dimension to again effect seating of the valve.

Figure 2:
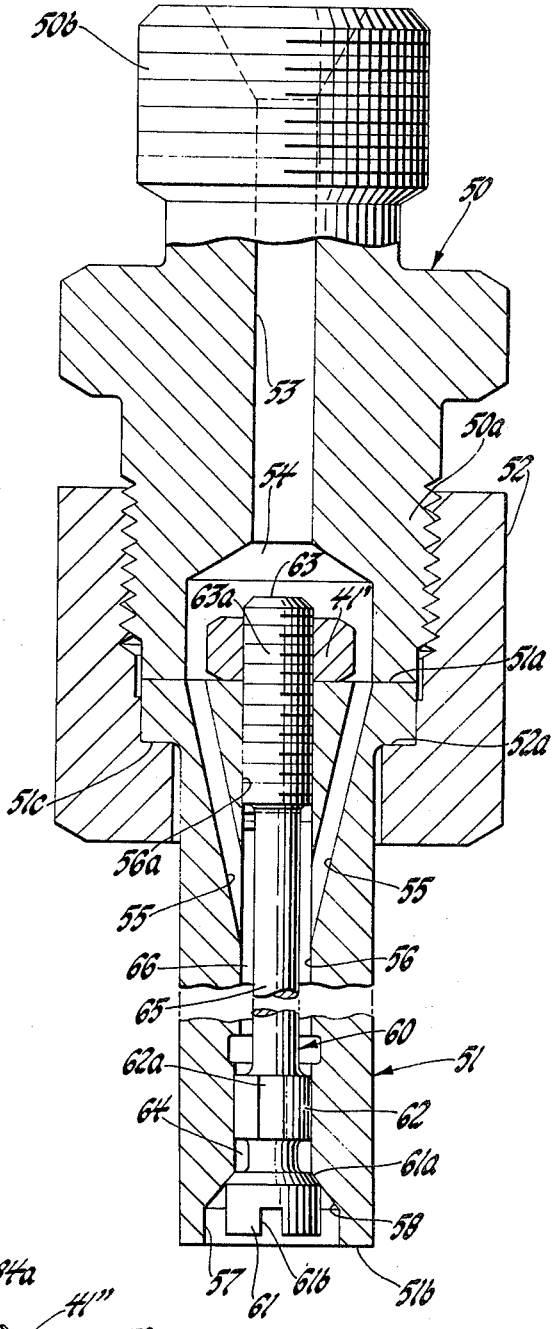
Figure 3:
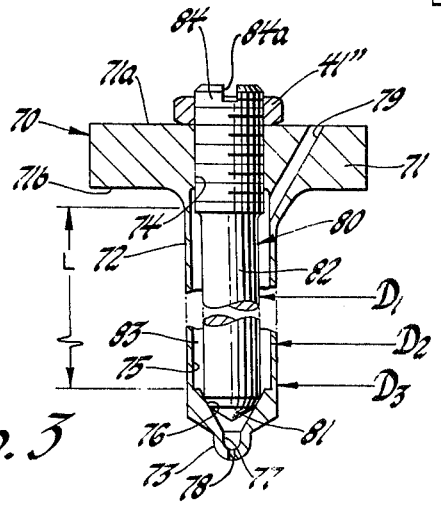

For a better understanding of the invention, as well as other objects and further features thereof, reference is had to the following detailed description of the invention to be read in connection with the accompanying drawings, wherein:

FIG. 1 is a longitudinal, sectional view through a portion of a unit type fuel pump-injector having a fuel injector nozzle assembly in accordance with one embodiment of the invention incorporated therein;

FIG. 2 is a longitudinal, sectional view through a fuel injector nozzle assembly per se, constructed in accordance with the invention, and utilizing a stretch valve therein; and, FIG. 3 is a longitudinal, sectional view showing an alternate embodiment of the nozzle body and valve of a fuel injector nozzle assembly wherein the nozzle body is the element that is stretched relative to the valve of this assembly whereby to effect unseating of the valve relative to its valve seat in the nozzle body.

Referring to FIG. 1, there is shown the subject fuel injector nozzle assembly with stretch element of the invention incorporated into a unit fuel pump-injector, only the lower portion of which is shown, since the upper portion thereof is of conventional construction and would, as is well known, include a housing, not shown, in which a pump plunger 2 is reciprocally mounted. Forming an extension of and threaded to the lower end of the housing is a sleeve nut 3 within which is supported a bushing 4 forming the pump cylinder for the plunger 2. An annular space or fuel chamber 5 surrounding the bushing 4 within the nut 3 is supplied with fuel at a relatively low supply pressure via passage means, not shown, in the housing from an external fuel inlet in a well-known manner, the fuel chamber 5 also being in communication with an outlet connection, not shown, also in a well-known manner.

The plunger 2 has the usual central passage, not shown, at the lower end thereof and the usual external metering groove helix, also not shown, adjacent to its lower end by which opening and closing of the lower port 6 and an upper port, not shown, in the bushing are controlled during each downward stroke of the plunger 2 to deliver a predetermined volume of fuel through the lower open end 7 of the bushing 4 for injection into the cylinder of an engine, not shown, via the fuel injector nozzle assembly of the invention, to be described, that is supported in the bottom of this unit injector.

Other details of the upper or pump part of the unit injector are not important to an understanding of the present invention and are common to conventional constructions of unit type fuel injectors, for example, a unit fuel pump-injector of the type as shown and described in such prior patents as U.S. Pat. No. 2,951,643 entitled "Fuel Injector with Pilot Injection" issued Sept. 6, 1960 to Royce G. Engle, Jr. and U.S. Pat No. 2,898,051 entitled "Fluid Injection Device" issued Aug. 4, 1959 to Conrad A. Teichert. Accordingly, a detailed description of the upper portion of the unit fuel pump-injector is not deemed necessary, especially since it forms no part of the subject invention.

Still referring to FIG. 1, the nut 3, in the form of a sleeve nut, has an opening 3*a* at its lower end through which extends the lower end of a fuel injection nozzle assembly constructed in accordance with the invention, this nozzle assembly including a nozzle body 10 and, sandwiched between the upper or inlet end 10*a* of the nozzle body 10 and the bottom of the bushing 4 is an annular spacer block 11 and a valve seat disk 12. As shown, the nozzle body 10 is enlarged above its lower end 10*c* to provide a shoulder 10*d* which seats on a shoulder 3*b* provided by the through counterbore in the nut 3. The housing, not shown, bushing 4 and the spacer block 11, although identified as separate elements, may be considered as a nozzle holder means, which together with the nut 3 and nozzle body 10 form a nozzle body means.

The lower end face 14 of the bushing 4 serves as a closure seat for a circular check valve disk 15. This check valve disk 15 is disposed in a cavity 16 formed in the upper end of the valve seat disk 12, the sides of the cavity 16 extending laterally beyond the lateral extremities of the open end 7 of the pump cylinder and serves to loosely guide the check valve disk 15. A central protuberance 17 is formed in the bottom of the cavity 16 and serves to limit opening travel of the check valve disk 15. The cavity 16 also forms the upper end of passage means connecting the open end 7 of the pump cylinder with the fuel discharge end of the nozzle body 10, this passage means also including one or more drilled passages 18 through the valve seat disk 12 that are in communication with a relatively large diameter axial bored passage 11*a* extending through the spacer block 11 and, one or more drilled passages 20 extending from the upper or inlet end 10*a* of the nozzle body 10 to intersect a straight through bore 21 in the nozzle body 10, this bore 21 extending from the upper or inlet end 10*a* of the nozzle body 10 through the lower spray tip or discharge end 10*b* of the nozzle body 10. The surface of the lower spray tip or discharge end 10*b* of the nozzle body is preferably of frusto-conical configuration to provide a valve seat for the valve, generally designated 30, of the subject fuel injector nozzle assembly.

The valve 30 includes a valve head 31 at one end thereof, the lower end with reference to FIG. 1, with a valve stem extending upward therefrom. As shown in FIG. 1, the valve head 31 is positioned outboard of the lower spray tip or discharge end 10*b* of the valve body and the valve stem is of an axial length so as to pass through the bore 21 of the nozzle body to extend outward from the opposite end thereof for a purpose to be described. The valve stem is provided with axial spaced apart upper and lower lands 32 and 33, respectively, of an outside diameter such as to be in slidable engagement with the wall of the bore 21 in the nozzle body 10 whereby the valve is concentrically located in the bore 21. As shown, the lower land 33 is provided with axial extending splined grooves 33*a* therein for the passage of fuel and it is axially spaced a short distance above the valve head 31 and, the upper land 32 is axially located on the stem so as to be positioned in the bore 21 of the nozzle body above the passages 20 therein, the portion 34 of the stem between the lands 32 and 33 and the portion 35 of the stem between the lower land 33 and the valve head 31 being of reduced diameter and therefore of a predetermined transverse cross sectional area for a predetermined axial or longitudinal length and it forms with the annular wall provided by the bore 21 in the nozzle body an annular fuel chamber 40 which, of course, is in communication at one end with a source of high pressure fuel as supplied through passage 20 and at its other end is normally closed by valve head 31 having its rear surface seated against the lower spray tip or discharge end 10*b* of the nozzle body. In the construction illustrated, the fuel chamber 40 actually consists of two annular chambers connected together in fluid communication with each other by the splined grooves 33*a* in the lower land 33. The rear or backside surface 31*a* of the valve head is shaped so as to conform with the valve seat surface provided by the lower spray tip or discharge end 10*b* of the valve body and, in the construction shown, would be of conical configuration.

The longitudinal or axial length of the valve stem of valve 30 is such that the free end 36 thereof above the upper land 32 extends into the axial through passage 11*a* in the spacer block 11 and this portion of the valve stem is provided with external threads 36*a* to threadedly receive a pair of nuts 41 loosely received in the passage 11*a* so as to provide with the spacer block 11 an annular fuel passage 42 therein. The lower nut 41 is torqued down on the valve stem against the inlet end 10*a* of the nozzle body 10 so as to preload the reduced diameter portion of the valve stem a predetermined amount so that the valve head 31 is normally closed, as shown, and the valve head is loaded into abutment against the valve seat of the nozzle body. With this arrangement, the end of the valve stem opposite valve head 31 is fixed to the nozzle body 10 against axial movement in at least one direction relative thereto. The upper nut 41 is used to lock the lower nut 41 in place after it has been torqued down. As shown, the valve head 31 is provided, for example, with a screwdriver receiving slot 31*b* whereby to restrain the valve against rotation while the nuts 41 are being driven.

The valve 30 is made of a suitable elastic material, such as steel, with a suitable modulus of elasticity whereby, by proper sizing of the diameter of the reduced diameter portion of the valve stem, which of course determines the transverse cross sectional area of the valve stem, relative to the effective area of the valve head exposed to the fuel pressure within the chamber 40, fuel at a predetermined opening pressure $P_o$ in the fuel chamber 40 will cause the stem of the valve 30 to stretch or lengthen in a longitudinal direction sufficiently to move the valve head in an axial direction to effect opening or unseating of the valve head 31 from the valve seat on the discharge end 10*b* to permit discharge of fuel from the fuel chamber 40 for injection into the combustion chamber of the engine. The above loading of the valve should be well within the elastic limit of the material so that when the fuel pressure around the reduced diameter stem of the valve 30 decreases to a closing pressure $P_c$, the stem can contract to its original longitudinal dimension to cause the valve head to retract in an axial direction whereby the valve head 31 again seats against the valve seat on the discharge end 10*b* of the nozzle body 10.

Referring now to FIG. 2, there is illustrated an embodiment of the subject fuel injector nozzle assembly incorporated into an injection nozzle, per se, which could be used as part of a fuel pump and nozzle system for an internal combustion engine. As is well known, such an injection nozzle, per se, when used in such a fuel pump and nozzle system for an engine, would be physically separated from the fuel pump but would be connected by suitable conduit means thereto. For this purpose, the injection nozzle shown in FIG. 2 includes a nozzle body means including a nozzle holder 50 and a nozzle body 51 clamped together by a sleeve nut 52 threaded onto the lower threaded portion 50*a* of the nozzle holder. As shown, the nozzle body 51 is formed with an enlarged upper or inlet end 51*a* to provide a shoulder 51*c* which seats on a shoulder 52*a* provided in the nut 52.

The nozzle holder 50 is provided with a fuel passage means therethrough as formed by stepped bore 53 extending through the nozzle holder and it is provided at its upper end with external threads 50*b* whereby the fuel passage means can be connected in fluid communication via a suitable fuel supply conduit, not shown, to the fuel pump, also not shown, in a known manner.

As shown, the stepped bore 53 provides a fuel passage in the nozzle holder that terminates in an enlarged cavity 54 at the lower end of the nozzle holder, the enlarged cavity 54 being partly closed on one side by the upper or inlet end 51*a* of the nozzle body. This cavity 54 is also in fluid communication with passage means in the nozzle body 51 that includes one or more drilled passages 55 extending from the upper or inlet end 51*a* of the nozzle body to intersect the inner peripheral wall provided by a straight stepped through bore 56 in the nozzle body 51, this bore 56, as shown, extending from the upper or inlet end 51*a* of the nozzle body 51 through the lower spray tip or discharge end 51*b* of the nozzle body. The bore 56 provides in sequence, starting at the lower spray tip or discharge end 51*b*, an annular inner peripheral wall 57 that is connected by an annular radial shoulder 58 to the main inner annular wall portion of the nozzle body formed by the major axial length portion of the bore 56, this shoulder 58 preferably providing a frusto-conical valve seat for the valve 60, to be described, of this assembly.

Referring now to the valve 60, it includes an enlarged valve head 61 at one end thereof, the lower end with reference to FIG. 2, with a valve stem extending therefrom. Still referring to FIG. 2, it will be seen that the valve head 61 is positioned within the nozzle body 51 so that it is encircled by the annular wall 57 and annular radial shoulder 58 and the valve stem thereof passes through the remainder of the bore 56 to extend outward from the opposite end of the nozzle body 51 into cavity 54. The stem of valve 60 is provided with a lower land 62 of an outside diameter such as to be in slidable engagement with the peripheral wall in the reduced diameter portion of the bore 56 in the nozzle body 51, this land 62 being axially spaced a predetermined distance from the valve head 61 whereby to concentrically position the valve and especially the valve head 61 relative to its seat. In addition, this land 62 is provided with axially extending splined grooves 62*a* therein for the passage of fuel. At its opposite end, the stem of the valve 60 is provided with a land portion 63 that is provided with external threads 63*a* thereon so that the lower portion of this land 63 can be threadedly engaged with the internal threads 56*a* provided in the bore of the nozzle bodys 51 at its upper end. In addition, as shown, the axial length of the stem of the valve 60 is such so that a portion of the land 63 of the stem of this valve extends outboard of the nozzle body into the cavity 54 whereby a nut 41' can be threaded thereon to serve as a thread lock.

Intermediate the head 61 and the land 62 and intermediate the land 62 and the land 63, the valve stem is provided with reduced diameter portions 64 and 65, respectively, and therefore of reduced transverse cross sectional area and of a predetermined axial or longitudinal length for a purpose to be described. These portions of the stem of the valve 60 form with the inner annular wall provided by the bore 56 in the nozzle body 51 an annular fuel chamber 66, similar to the previously described fuel chamber 40, the fuel chamber 66 being in communication at one end with a source of high pressure fuel via the passages 55 and at its other end is normally closed by the valve head 61 seated against the valve seat as provided by shoulder 58. The rear or backside surface 61*a* of the valve head 61 is shaped so as to conform with the frusto-conical valve seat surface provided by the annular radial shoulder 58. In addition, the outboard end of the valve head 61 is provided with, for example, a screwdriver engaging slot 61*b* whereby the valve 60 can be threaded in the nozzle body 51 and torqued down whereby to preload the reduced diameter portion of the valve stem a predetermined amount so that the valve head 61 is in a normally closed position, as shown, relative to its valve seat or shoulder 58 in the nozzle body and it is in loaded abutment against the valve seat of the nozzle body. After the valve stem has been suitably preloaded, the nut 41' is torqued down on the threads 63*a* of land 63 of the valve stem so as to lock the valve in the above described loaded condition.

The valve 60, like the valve 30, is also made of a suitable elastic material of a desired modulus of elasticity whereby, by proper selection of the diameter of the reduced diameter portion of the valve stem which, of course, determines its cross sectional area, and the area of the valve head 61 exposed to fuel pressure in the chamber 66, when fuel at an opening pressure $P_o$ is supplied to the annular fuel chamber 66 to act on the head 61 of the valve, the stem of the valve 60 will stretch or lengthen longitudinally sufficiently to effect opening or unseating of the valve head 61 from the valve seat in the nozzle body so as to permit injection of fuel into the combustion chamber of the engine from the chamber 66. In addition, as previously described, when the fuel pressure around the reduced diameter stem of the valve 60 decreases to a closing pressure $P_c$, the stem will then be permitted to contract to its original longitudinal dimension so as to again effect seating of the valve head 61 against the valve seat in the nozzle body 51.

It will be apparent that, in the injection nozzle assemblies thus far described, with reference to FIGS. 1 and 2, although the valve in each of these assemblies is fixed at one end relative to one end of its associated nozzle body, each valve is capable of stretching when acted upon by a predetermined fuel pressure whereby its effective longitudinal length is increased so as to cause opening or unseating of its valve head realtive to its valve seat in the nozzle body with which it cooperates.

Referring now to FIG. 3, there is shown an alternate embodiment of an injection nozzle consisting of an assembly of a nozzle body 70 and valve 80 which could be used, for example, in conjunction with the nozzle holder 50 and sleeve nut 52 of the nozzle assembly shown in FIG. 2 to form therewith an injection nozzle assembly per se or, alternately, it could be used in a unit fuel injector of the type illustrated in FIG. 1. In this alternate embodiment of the injection nozzle shown in FIG. 3, the valve 80 of this assembly remains stationary while the nozzle body is caused to be stretched whereby to effect unseating of the valve 80 relative to its valve seat in the nozzle body 70.

Referring first to the nozzle body 70, it includes an enlarged upper end 71, with an intermediate or reduced diameter portion 72 of thin walled tubular configuration extending therefrom, the latter terminating at a thicker walled spray tip 73. The upper end 71 provides an annular flange or shoulder **71*b* to seat, for example, against the shoulder 52*a* in the nut 52. The nozzle body 70 is formed with a threaded bore 74 through its upper end 71 which is concentric with an enlarged annular cavity as provided by an annular inner wall 75 of the intermediate or reduced diameter portion 72, and the spray tip is formed with a conical valve seat 76 concentric with a bored passage 77 that communicates with a spray tip opening or discharge orifice 78 at the end of the spray tip 73. One or more drilled passages 79 extend from the upper surface 71*a* of the upper end 71** to extend through to the cavity in the nozzle body.

The valve 80 in the form of a needle valve includes a head 81 having a conical surface formed complementary to the valve seat 76 and, a stem portion 82 that extends through the cavity in the nozzle body 70 to form therewith an annular fuel chamber 83 which is in communication with a source of high pressure fuel via the passages 79. The stem of the valve opposite the head 81 is provided with an enlarged externally threaded stem portion 84 in threaded engagement with the threaded bore 74 in the upper end 71 of the nozzle body. As shown, the upper end of the stem portion 84 is provided, for example, with a slot **84*a* to receive a screwdriver whereby the valve can be torqued so that its head 81 is in a normally closed position relative to the valve seat 76 in the nozzle body 70 and it is in abutment against the valve seat so that a predetermined load can be applied via this valve stem on the intermediate or reduced diameter portion 72 of the nozzle body. After the intermediate or reduced diameter portion 72 has been preloaded with a desired force load, the nut 41" is torqued down on the threads 84 into abutment with the upper end 71 of the nozzle body to lock the valve 80** in position.

As shown in FIG. 3, the intermediate or reduced diameter portion 72 of the nozzle body is formed with a predetermined reduced wall thickness relative to the upper end 71 and spray tip 73 end thereof and, of course, this nozzle body is formed of suitable elastic material whereby with fuel at a predetermined opening pressure $P_o$ in the fuel chamber 83 of this assembly, this intermediate or reduced diameter portion 72 would lengthen sufficiently in an axial or longitudinal direction whereby the valve seat 76 in the nozzle body 70 would move relative to the head 81 of the valve 80 whereby to effect opening or unseating of the valve relative to its valve seat so as to place the fuel chamber 83 in fluid communication with the passage 77 and orifice 78 so as to permit discharge of fuel from the nozzle. Of course, when the fuel pressure in the fuel chamber is reduced or decreased to a closing pressure $P_c$, the intermediate or reduced diameter portion 72 of the nozzle body would then contract to retract the valve seat 76 into seating engagement with the head 81 of valve 80.

For the purpose of more clearly describing the operational details of the subject fuel injection nozzle assembly, the constructional details of the fuel injection nozzle assembly shown in FIG. 3 are described in detail hereinafter.

Thus, in a particular embodiment of the injection nozzle assembly of FIG. 3 that was constructed, the nozzle body was made of a material having a modulus of elasticity (Young's modulus) E of $30 \times 10^6$ psi. In this construction, the outside diameter $D_3$ of the intermediate or reduced diameter portion 72 of the nozzle body was 0.315 inch, while the inside diameter $D_2$ of the inner peripheral wall 75 of this portion of the nozzle body was 0.294 inch providing a transverse cross section area for the wall of the portion 72 of 0.01 inch and, the diameter $D_1$ of the valve stem 82 of the valve 80 was 0.170 inch. The tip or head preload $F_p$ of the valve head against the nozzle body and therefore on the intermediate portion 72 of the nozzle body 70 at the zero opening, that is, with the valve head seated against its valve seat in the position shown, was 135.6 pounds giving a column stress on the intermediate or reduced diameter portion 72 of 13,560 psi. The effective length L of the intermediate or reduced diameter portion 72 was 1.25 inch.

With this arrangement, the effective opening pressure $P_o$ of this assembly, that is, the pressure of fuel within chamber 83 needed to effect longitudinal stretching of the nozzle body and thereby effecting opening movement of the valve seat 76 in the nozzle body relative to the valve head 81 was 3,000 psi, with a typical injection pressure P of 10,000 psi. The closing pressure $P_c$ for this structure was 1,997 psi so that when the pressure of fuel in chamber 83 decreased to this pressure, the nozzle body 70 and, specifically, the intermediate portion 72 thereof could contract to effect seating of the head 81 of valve 80 against the valve seat 76 so as to terminate fuel injection. The nozzle body, as it is stretched, as described, will cause the valve seat 76 to effectively travel 0.002264 inch relative to the fixed position of the valve head 81 in an axial direction away from the head in an opening direction, and at that time, the tip load $F_1$ "due" to tip travel "T" was 679 pounds with a column stress at injection pressure P of 67,900 psi with the intermediate or reduced diameter portion 72 of the nozzle body, as previously described, having been originally stressed to a preload pressure of 13,560 psi. It will be apparent that the above pressures acting on the material from which the nozzle body has been fabricated will apply a maximum stress load thereon which is substantially below the modulus of elasticity of the material and, thus, the stress load applied is well within the elastic limit of the material so that no permanent deformation of this element will occur.

It will be apparent from the above that either the valve element in the nozzle assembly of FIGS. 1 and 2 or the nozzle body element of the nozzle assembly of FIG. 3 should be made of a selected elastic material having a suitable modulus of elasticity whereby the material will have the ability to stretch and then to return to its original dimension after the removal of a stress load thereon. It will also be apparent that either the valve in the assembly of FIGS. 1 and 2 or the nozzle body in the assembly of FIG. 3 should be dimensioned and the load applied thereto should be such that the column load thereon, as applied by the preload and the fuel pressure P acting thereon, will stress the element well within the elastic limit of the material used to fabricate the element. It will also be apparent that a rigid connection be effected between the valve and the nozzle body so that all longitudinal stretching will occur in one direction only whereby to effect unseating of the valve head relative to its seat in the nozzle body.

It will be apparent to those skilled in the art that, in the above described fuel injection nozzle assembly of the invention, the non-stretching element in each assembly, that is, the nozzle body in each of the assemblies of FIGS. 1 and 2 and the valve in the assembly of FIG. 3, would be constructed so that their longitudinal dimensions preferably do not change under the working fuel pressures encountered in these assemblies.

What is claimed is:

1. In an injector nozzle assembly, a nozzle body having a spray tip at one end thereof, the nozzle body having a stepped bore extending from the opposite end of the nozzle body from said spray tip to communicate with the spray tip and providing at the spray tip an annular valve seat concentric with said stepped bore, a valve having a valve head and a stem extending therefrom said valve being positioned to extend through said stepped bore in said nozzle body with said valve head normally positioned in loaded abutment against said valve seat, the end of said stem opposite said valve head being connected to said opposite end of said nozzle body to prevent axial movement of said end of said stem in at least one direction relative to said nozzle body, said valve stem forming with an inner annular wall in said nozzle body as provided by said stepped bore an annular fuel chamber in communication at one end with said valve seat as controlled by said valve head of said valve, said nozzle body further including a fuel inlet passage means connected at one end to said annular fuel chamber and connectable at its other end to a source of pressurized fuel, said nozzle body including an annular body portion next adjacent said spray tip encircling said valve stem to provide therewith at least part of said annular fuel chamber, said body portion being of a predetermined inside diameter and outside diameter providing a thin wall of reduced cross sectional area compared to the remaining portions of the nozzle body and of a predetermined longitudinal length whereby, when fuel at a predetermined pressure is in said annular fuel chamber, said body portion is stretched to effect unseating of said valve seat from said valve head and, when the pressure of fuel in said annular fuel chamber decreases, said body portion contracts so that said valve head is again seated against said valve seat.

2. A fuel injector nozzle assembly including a nozzle body means having a nozzle body with an exposed spray tip at one end thereof through which fuel is discharged, said nozzle body means having fuel passage means therein including an enlarged chamber connectable to a source of high pressure fuel, said enlarged chamber being partly closed at one end by the opposite end of said nozzle body from said spray tip, said nozzle body including a bored passage means therethrough providing internal annular wall means in said nozzle body and an annular valve seat at said spray tip and, a valve positioned in said nozzle body, said valve having a valve head with a stem extending therefrom, said stem extending though said opposite end of said nozzle body and forming with said annular wall means an annular fuel chamber in said nozzle body, fuel delivery passage means in said nozzle body in communication at one end with said chamber and at its opposite end with said annular fuel chamber, said annular fuel chamber terminating at one end thereof in a fuel outlet in said spray tip of said nozzle body with flow therefrom controlled by said valve head positioned to normally engage said valve seat, the end of said valve stem opposite said valve head being fixed to said opposite end of said nozzle body against axial movement in at least one direction and to position said valve head in loaded abutment against said valve seat, said nozzle body including an annular body portion next adjacent said spray tip encircling said valve stem to provide therewith at least part of said annular fuel chamber, said body portion being of a predetermined inside diameter and outside diameter whereby to provide a thin wall of reduced cross sectional area compared to the remaining portions of said nozzle body and of a predetermined longitudinal length whereby, when fuel at a predetermined pressure is in said annular fuel chamber, said body portion is stretched to effect unseating of said valve seat from said valve head and, when the pressure of fuel in said annular fuel chamber decreases to a second predetermined pressure, said body portion contracts so that said valve head is again seated against said valve seat.

3. A nozzle body and valve assembly for use in an injector nozzle assembly, said nozzle body and valve assembly including a nozzle body having a rigid body portion at one end, an annular thin wall intermediate portion of predetermined longitudinal length and, a rigid spray tip at its opposite end having a fuel outlet means therein, and a valve positioned in said nozzle body with one end of said valve fixed to said rigid body portion and its other end positioned to normally close said fuel outlet means, said valve having an intermediate stem portion between said one end of said valve and said other end of said valve encircled by said intermediate portion of said nozzle body to provide an annular fuel chamber in fluid communication with said fuel outlet means as controlled by said valve, said rigid body portion of said nozzle body including fuel passage means connectable at one end to a source of pressurized fuel and connected in fluid communication at its opposite end with said annular fuel chamber, said thin wall of said intermediate portion being of a reduced predetermined transverse cross sectional area whereby when fuel at a predetermined high fuel pressure is in said annular fuel chamber, said thin wall intermediate portion of said nozzle body will stretch so as to effect opening of said valve for the discharge of fuel from said annular fuel chamber through said fuel outlet means and normally when fuel at a reduced pressure is in said annular fuel chamber, said thin wall intermediate portion of said nozzle body will be at its normal contracted longitudinal length whereby said valve is positioned to block fluid flow from said annular fuel chamber through said fuel outlet means.

* * * * *